United States Patent [19]

Rodriguez

[11] 4,297,985

[45] Nov. 3, 1981

[54] CATAPULT DEVICE AND PROJECTILE THEREFORE

[76] Inventor: Rudolph Rodriguez, P.O. Box 423, Fowler, Calif. 93625

[21] Appl. No.: 99,743

[22] Filed: Dec. 3, 1979

[51] Int. Cl.[3] ..... F41B 7/00

[52] U.S. Cl. ..... 124/22; 273/423; 273/416; 124/83; 124/41 R

[58] Field of Search ..... 124/22, 21, 17, 16, 124/41 R, 20 R, 20 B, 80, 83, 23 R, 24 R, 25, 26, 27

[56] References Cited

U.S. PATENT DOCUMENTS

| | | | |
|---|---|---|---|
| 159,452 | 7/1850 | Sundberg . | |
| 181,891 | 9/1876 | Algeo | 124/22 |
| 368,588 | 8/1887 | Horton . | |
| 1,379,944 | 5/1921 | Story . | |
| 2,522,060 | 9/1950 | Ridland . | |
| 2,672,857 | 3/1954 | Gauthier . | |
| 3,026,864 | 3/1962 | Gray | 124/27 |
| 3,119,385 | 2/1967 | Spatari . | |
| 3,119,385 | 1/1964 | Ashley . | |
| 3,375,815 | 4/1968 | Novak | 124/23 R |
| 3,749,075 | 7/1973 | Saunders . | |
| 3,865,094 | 2/1975 | Sweeney | 124/20 R |
| 3,983,860 | 10/1976 | Bolton | 124/20 R |

*Primary Examiner*—Richard C. Pinkham
*Assistant Examiner*—William R. Browne
*Attorney, Agent, or Firm*—Huebner & Worrel

[57] ABSTRACT

A catapult device and projectile therefore, the catapult device having a body member intersected by a passage having a predetermined cross sectional configuration and including a slot composing part of and extending longitudinally of the passage and a resilient band borne by the body member for propelling the projectile through the passage and from the body member, and the projectile having a cross sectional configuration conforming to the passage of the body member and including a fin extended longitudinally of the projectile.

The passage has slots which extend radially in a pattern relative to the axis of the passage and extend the entire length of the passage. In the passage is slidably disposed the projectile which has fins extending radially therefrom in a pattern matching the slots, and they extend substantially the entire length of the projectile.

4 Claims, 5 Drawing Figures

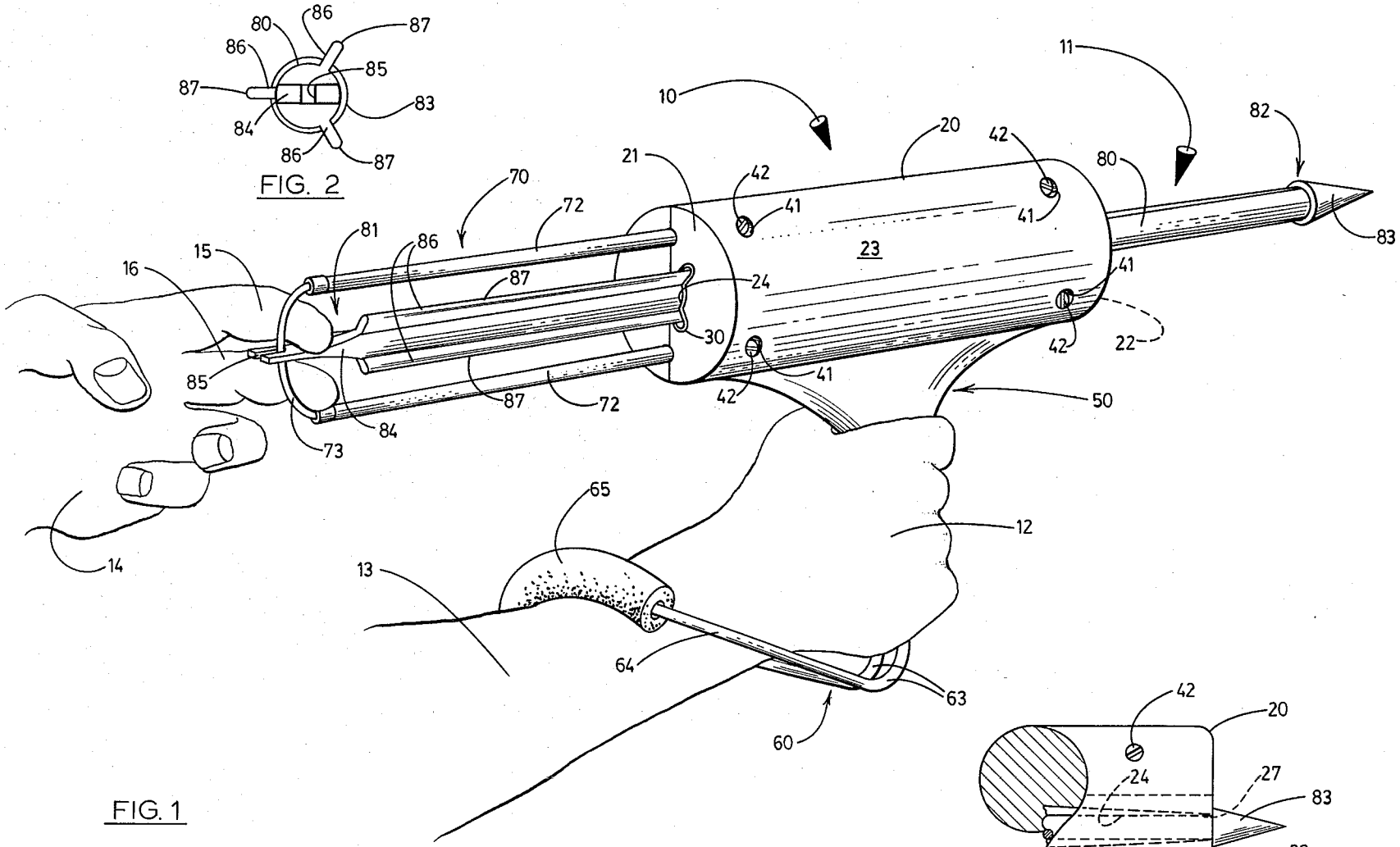
FIG. 1
FIG. 2
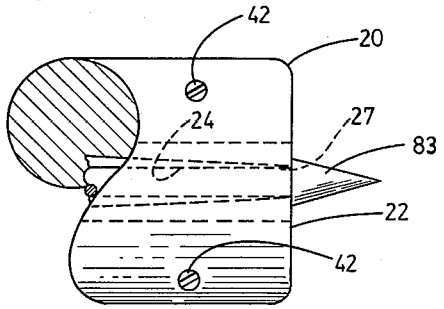
FIG. 3

CATAPULT DEVICE AND PROJECTILE THEREFORE

BACKGROUND OF THE INVENTION

1. Field Of The Invention:

The present invention relates to a catapult device and projectile therefore and more particularly to such a device and projectile which operate cooperatively for purposes either as a weapon, sporting or amusement device to propel the projectile along a path of flight with an accuracy not heretofore achieved.

2. Description Of The Prior Art:

It has been known in weapons, sporting devices, amusement devices and the like to employ projectiles of a variety of types in combination with various propelling devices to catapult the projectiles along trajectories toward a target. A phenomenon characteristic of such devices is the tendency for the projectile to tumble or to rotate, concentrically or eccentrically, about its longitudinal axis during movement along the trajectory. While in certain applications concentric rotation may be desirable, in many other applications, rotation or tumbling of any type detracts both from the accuracy of the device as well as its range.

It has, therefore, long been known that it would be desirable to have a catapult device and projectile therefore which cooperate to achieve an accuracy and range superior to that heretofore achieved, which are of dependable yet inexpensive construction, and which are adaptable for use as a weapon, sporting or amusement device.

SUMMARY OF THE INVENTION

Therefore, it is an object of the present invention to provide an improved catapult device and projectile therefore.

Another object is to provide such a device and projectile which operate cooperatively to enhance both the accuracy and range achievable in a device which is compact and inexpensive to manufacture.

Another object is to provide such a device and projectile which possess a safety of operation not heretofore achieved.

Another object is to provide such a device and projectile which can easily be used with precision and with no prior instructions.

Another object is to provide such a device and projectile which can, if desired, be operated successively and rapidly to propel a series of projectiles with considerable accuracy and with only a minimum of skill.

Further objects and advantages are to provide improved elements and arrangements thereof in an apparatus for the purposes described which is dependable, economical, durable and fully effective in accomplishing its intended purposes.

BRIEF DESCRIPTION OF THE DRAWINGS

FIG. 1 is a perspective view showing the catapult device and projectile of the present invention in a typical attitude in use by an operator.

FIG. 2 is a somewhat enlarged rear view of the projectile of the present invention.

FIG. 3 is a fragmentary side elevation of the catapult device and projectile showing the projectile fully retracted within the launching passage of the device.

DESCRIPTION OF THE PREFERRED EMBODIMENT

Referring more particularly to the drawings, the catapult device of the present invention is generally indicated by the numeral 10 and the projectile by the numeral 11 in FIG. 1. For illustrative convenience, the catapult device and projectile are shown in FIG. 1 in a typical operative attitude in use by an operator. The operator's right hand is indicated at 12, forearm at 13 and left hand at 14. The left hand of the operator is shown in FIG. 1 with the index finger 15 and middle finger 16 extended as shown.

Figure 4:
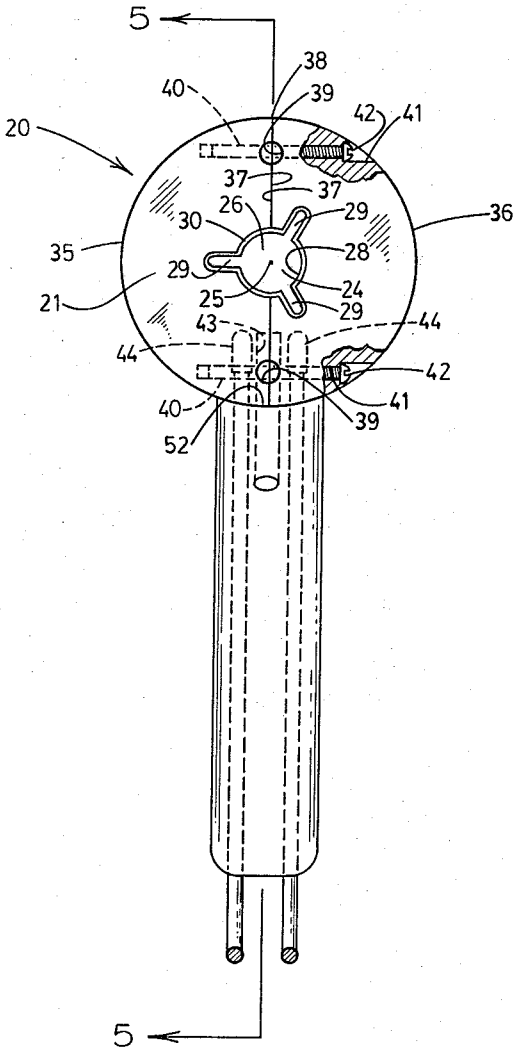
FIG. 4 is a somewhat enlarged rear view of the catapult device with portions broken out for illustrative convenience.

The catapult device 10 has a substantially cylindrical body member 20 extending from a proximal end 21 to an opposite distal end 22. The body member has a cylindrical outer surface 23. A launching passage 24 extends through the body member along an axis 25 from a proximal aperture 26 in the proximal end 21 to a distal aperture 27 in the distal end 22. The cylindrical outer surface 23 of the body member is preferably, although not necessarily, concentric to the axis 25. The launching passage has a substantially cylindrical interior surface 28 extending along and preferably concentric to the axis 25. The passage has three fin slots 29 radially extending from the interior surface 28 and being spaced equal distances about the axis of the launching passage, as can best be seen in FIG. 4.

The launching passage 24, including the fin slots 29 thereof, is preferably covered with a lining 30 having a low coefficient of friction. The lining can be a coating substance or an insert of a material such as Teflon or the like.

The body member 20 is composed of a first body portion 35 and a substantially identical second body portion 36 which are joined along mating surfaces 37 disposed in facing engagement along a parting plane 38.

Figure 5:
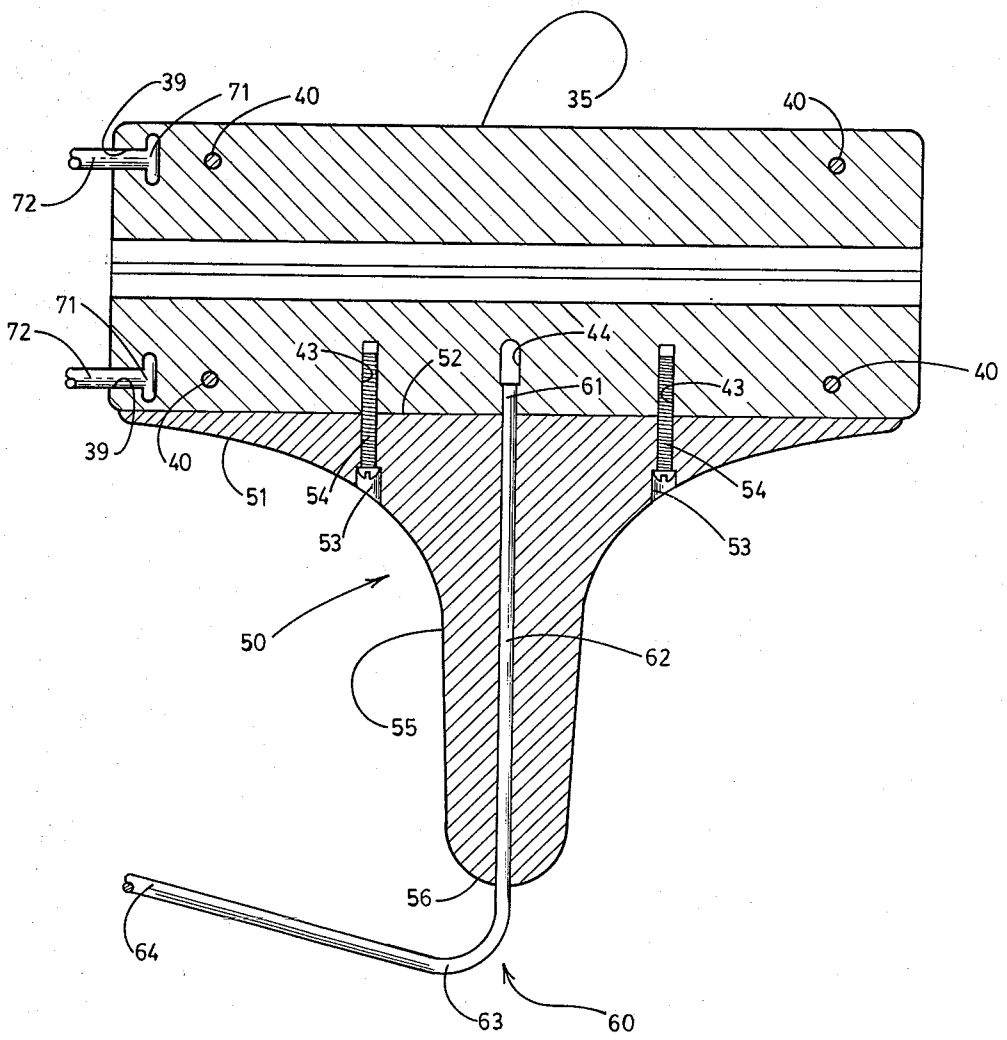
FIG. 5 is a fragmentary longitudinal section taken on line 5—5 in FIG. 4.

The first body portion has a pair of T-grooves 39 formed therein and communicating with the proximal end 21 of the body member 20, as best shown in FIG. 5. The first body portion has four screw threaded holes 40 extending from the mating surface 37 thereof inwardly of the first body portion in the pattern shown in FIG. 5. The second body portion has four countersunk screw holes 41 extending therethrough in a pattern corresponding to that of the screw threaded holes 40. The body member is retained in assembled relation by four screws 42 individually extending through the countersunk screw holes of the second body portion and secured in the threaded holes 40 of the first body portion to retain the first and second body portions in facing engagement. A pair of screw threaded holes 43 are extended into the body member intermediate the proximal and distal ends 21 and 22 respectively thereof and substantially normal to the axis 25 of the launching passage.

The catapult device 10 has a hand grip 50. The hand grip has a flared portion 51 with a concave surface 52 disposed in facing engagement with the cylindrical surface 23 of the body member 20. A pair of countersunk screw holes 53 are entended through the flared portion of the hand grip in the same pattern as the screw threaded holes 43 of the body member. A pair of screws 54 are individually extended through the holes 53 and secured in the threaded holes 43 to mount the hand grip on the body portion, as best shown in FIG. 5. The hand grip has a grip portion 55 extending to a remote end 56.

A forearm brace 60 is embedded in the hand grip 50. The forearm brace is a continuous, rigid wire or rod having two terminal ends 61 which are individually received in the holes of the pair of holes 44 of the body member 20. The brace has grip portions 62 extending in substantially parallel relation through the grip portion 55 of the hand grip exiting from the grip portion through the remote ends 56 thereof. The brace has a pair of bent portions 63 extending to a looped portion 64 spaced from the hand grip a sufficient distance to be rested on the forearm 13 of an operator gripping the hand grip, as shown in FIG. 1. A tubular cushion or pad 65 is received about the looped portion 64 of the forearm brace.

The catapult device 10 has a resilient band 70 having T-shaped ends 71 individually fitted in the T-grooves 39 of the first body portion 35 and thereby captured between the assembled first and second body portions 35 and 36, as best shown in FIG. 1. The band has a pair of resilient portions 72 interconnected by a rigid grasping portion 73 of sufficient size to permit the index and middle fingers 15 and 16 respectively of the operator to be positioned as shown in FIG. 1 with respect to the projectile 11.

The projectile 11 has an enlongated cylindrical shaft 80 which is preferably of substantially greater length than the body member 20. The shaft has a proximal end portion 81 and an opposite distal end portion 82. The distal end portion has a conical head 83 which preferably has a diameter at its base which is larger than the diameter of the cylindrical interior surface 28 of the launching passage 24. The proximal end portion has a tapered tail 84 in which is provided a groove 85 having a width sufficient to receive the grasping portion 73 therewithin, as best shown in FIG. 1.

Three radially extending tapered fins 86 are mounted on the shaft 80 of the projectile extending from the conical head to the tapered tail thereof. The fins are spaced equal distances from each other about the shaft as can best be seen in FIG. 2. The fins have extended edges 87 which are tapered gradually outwardly from the shaft from a position immediately adjacent to the conical head 83, at which they preferably join the shaft, to the tapered tail at which they are of only slightly shorter length than the fin slots 29 of the launching passage 24. Thus, it will be seen that the projectile can be slidably received in the launching passage in the attitude shown in FIG. 1 and retracted therealong to a position at which the conical head 83 abuts the distal end 22 of the body member, thus constituting a fully retracted position. Similarly, the fins are individually received in the fin slots 29 and slidable therewithin as facilitated by the lining 30 of the launching passage.

OPERATION

The operation of the described embodiment of the subject invention is believed to be clearly apparent and is briefly summarized at this point. In use, the projectile 11 is slidably received in the launching passage 24 so that the fins 86 are individually received in the fin slots 29, as best shown in FIG. 1. Thus, the projectile is inserted tail first through the distal aperture 27. The operator grasps the grip portion 55 of the band grip 50 with the looped portion 64 of the forearm brace 60 rested about the forearm 13 of the operator as shown in FIG. 1. The left hand 14 of the operator preferably grasps the tail 84 of the projectile with the index and middle fingers 15 and 16 respectively and with the grasping portion 73 received in the groove 85 of the tail of the projectile.

The operator then retracts the projectile 11 along the launching passage 24 against the tension of the resilient band 70 until the desired degree of tension has been reached. It will be seen that engagement of the conical head 83 in abutted relation with the distal end 22 of the body member constitutes a point of maximum retraction of the projectile. This serves several functions including preventing the inadvertent overtensioning of the band, jamming the head 83 in a launching passage, damaging the catapult device or projectile, or pulling the projectile completely through the launching passage.

When the desired position for the projectile 11 has been reached against tension of the band, the operator aims the catapult device 10 at the desired target and releases the grasping portion 73 of the band and the projectile by removing the index and middle fingers 15 and 16 therefrom. Release of the grasping portion and projectile causes the band to propel the projectile along the launching passage 24 and from the distal aperture 27 of the launching passage. Slidable movement of the fins along their respective fin slots 29 operate to prevent rotation of the projectile about its longitudinal axis during movement along the launching passage to stabilize it for release therefrom so as to enhance accuracy. Similarly, such action maximizes the range of flight by minimizing the wind resistance thereof particularly as compared with a tumbling or rotating projectile.

The fins 86 of the projectile 11 operate not only to guide the projectile along the launching passage 24 stabilizing such movement and the trajectory of the projectile, but also operate to guide the projectile through the atmosphere after release from the passage. The extension of the fins in rearwardly tapered relation along virtually the entire length of the projectile provide an additional stabilizing effect in that the projectile is effectively directed into the desired trajectory during movement along the passage. Once the portions of the fins adjacent to the tail 84 reach the passage, the size and shape of the portion of the projectile within the passage closely conforms to that of the passage thus precisely guiding the projectile into axial alignment with the axis 25. The axis 25 is thus coaxial with the trajectory of the projectile.

It will be understood that any desired sight can be employed for purposes of aiming the catapult device 10 as best suited to the desired use thereof. For example, when the catapult device is used as a weapon, a rather sophisticated aiming device can be employed. Conversely, when the device is employed for purposes of amusement, it may be unnecessary to provide any sort of aiming mechanism. It will also be seen that any suitable head can be substituted for the conical head 83. Thus, a suction cup, cushion, or the like can be employed where used as an amusement device. Alternatively, a more lethal head can be used where used as a weapon.

Therefore, the catapult device and projectile therefore of the present invention are compact and inexpensive to produce and afford a cooperative action in use which achieves a high degree of accuracy with little or no instruction or practice.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A catapult device and projectile therefore comprising a body member, having opposite proximal and distal ends, intersected by a passage extending along an axis through the body member interconnecting said proximal and distal ends, said passage having slots extending radially in a pattern relative to said axis of the passage and extending the entire length of the passage; a grip mounted on the body member; a resilient band mounted on the proximal end of the body member; a projectile of greater length than the passage of the body member, having opposite proximal and distal end portions, transversely dimensioned to be slidably received in the passage and having fins extending radially therefrom in a pattern matching the slots of the body member and extending substantially the entire length of the projectile tapering outwardly therefrom from the distal end portion to the proximal end portion and the fins at said proximal end portion extending radially therefrom a distance nearly equivalent to that of said slots; and a head borne on the distal end portion of the projectile having a transverse dimension greater than at least one transverse dimension of the passage of the body member permitting said projectile to be slidably received in the passage of the body member and retracted by its proximal end portion against the resilient band until the head contacts the distal end of the body member to place the resilient band under tension limited by the contact of the head with the distal end of the body member for release at a velocity controlled thereby along a course controlled by passage of the fins of the projectile in the slots of the body member.

2. The catapult device and projectile of claim 1 including a lining having a low coefficient of friction mounted on the body member within the passage thereof extending into the slots thereof to conform to said pattern of the slots and easing movement of the projectile along the passage.

3. The catapult device and projectile of claim 1 including a continuous rigid rod mounted on the grip remote from the body member and having portions extending from the grip obliquely in converging relation to the axis of the passage and from each other to form a loop dimensioned to rest on the forearm of an operator grasping the grip to resist movement of the body member during retraction of the projectile against the resilient band.

4. The catapult device and projectile of claim 2 wherein the body member is separable into portions parting along the passage of the body member for repair or replacement of portions thereof.

* * * * *

UNITED STATES PATENT AND TRADEMARK OFFICE

CERTIFICATE OF CORRECTION

PATENT NO. : 4,297,985

DATED : November 3, 1981

INVENTOR(S) : Rudolph Rodriguez

It is certified that error appears in the above-identified patent and that said Letters Patent are hereby corrected as shown below:

Column 2, line 66, change "entended" to

---extended---.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*